US005540353A

United States Patent [19]

Coleman et al.

[11] Patent Number: 5,540,353

[45] Date of Patent: Jul. 30, 1996

[54] CANDY CONTAINER AND DISPENSER

[76] Inventors: Thomas J. Coleman, 89 Winding Way Rd., Bristol, Va. 24201; William K. Schlotter, IV, 175 Toluca Rd., Stafford, Va. 22554; Princess A. Coleman, 89 Winding Way Rd., Bristol, Va. 24201; Ann M. Schlotter, 175 Toluca Rd., Stafford, Va. 22554

[21] Appl. No.: 408,964

[22] Filed: Mar. 23, 1995

[51] Int. Cl.[6] ..... A24F 15/04

[52] U.S. Cl. ..... 221/24; 215/376

[58] Field of Search ..... 221/24, 197, 303, 221/306; 215/306, 370, 376

[56] References Cited

U.S. PATENT DOCUMENTS 1,806,479 5/1931 Lory ..... 215/306

4,082,200 4/1978 Guest et al. ..... 215/376

*Primary Examiner*—Kenneth Noland

*Attorney, Agent, or Firm*—Melvin L. Crane

[57] ABSTRACT

A container and dispenser including a main housing. The main housing has a top enclosure with an aperture therein with the bottom having a balance ring and a semi-spherical enclosure. The balance ring and bottom enclosure is such that the main housing will stand at an angle and will wobble on the bottom end in an upright position. A top cap is provided to close the aperture in the upper end enclosure. Hard pieces of candy having a size smaller than the aperture can be dispensed from the housing by shaking the housing with the cap removed.

6 Claims, 2 Drawing Sheets

CANDY CONTAINER AND DISPENSER

This invention is directed to a candy container and dispenser and more particularly to a candy container from which pieces of candy are dispensed by shaking the holder.

Heretofore various containers have been used from which something is dispensed by shaking the container. Some such devices include salt and pepper shakers, liquid dispensers from which one drop at a time is dispensed as well as others. The following patents illustrate devices from which something is dispensed, U.S. Pat. Nos. 2,071,101; 2,361,580; 3,112,046; 4,986,442; and 5,338,242.

It is therefore an object of this invention to provide a candy container from which pieces of candy are dispensed by shaking the container.

Another object is to provide a candy container from which only one piece of candy can be dispensed at one time.

Still another object is to provide a candy container which is adapted to permit only one piece of candy to be dispensed at any one time.

Yet another object is to provide a candy container from which only one piece of candy can be dispensed at any one time but in addition functions as a noise maker or rattle during shaking the container.

Other objects and advantages will become obvious for a description of the device and the drawings.

DETAILED DESCRIPTION OF THE DISCLOSURE

Figure 1:
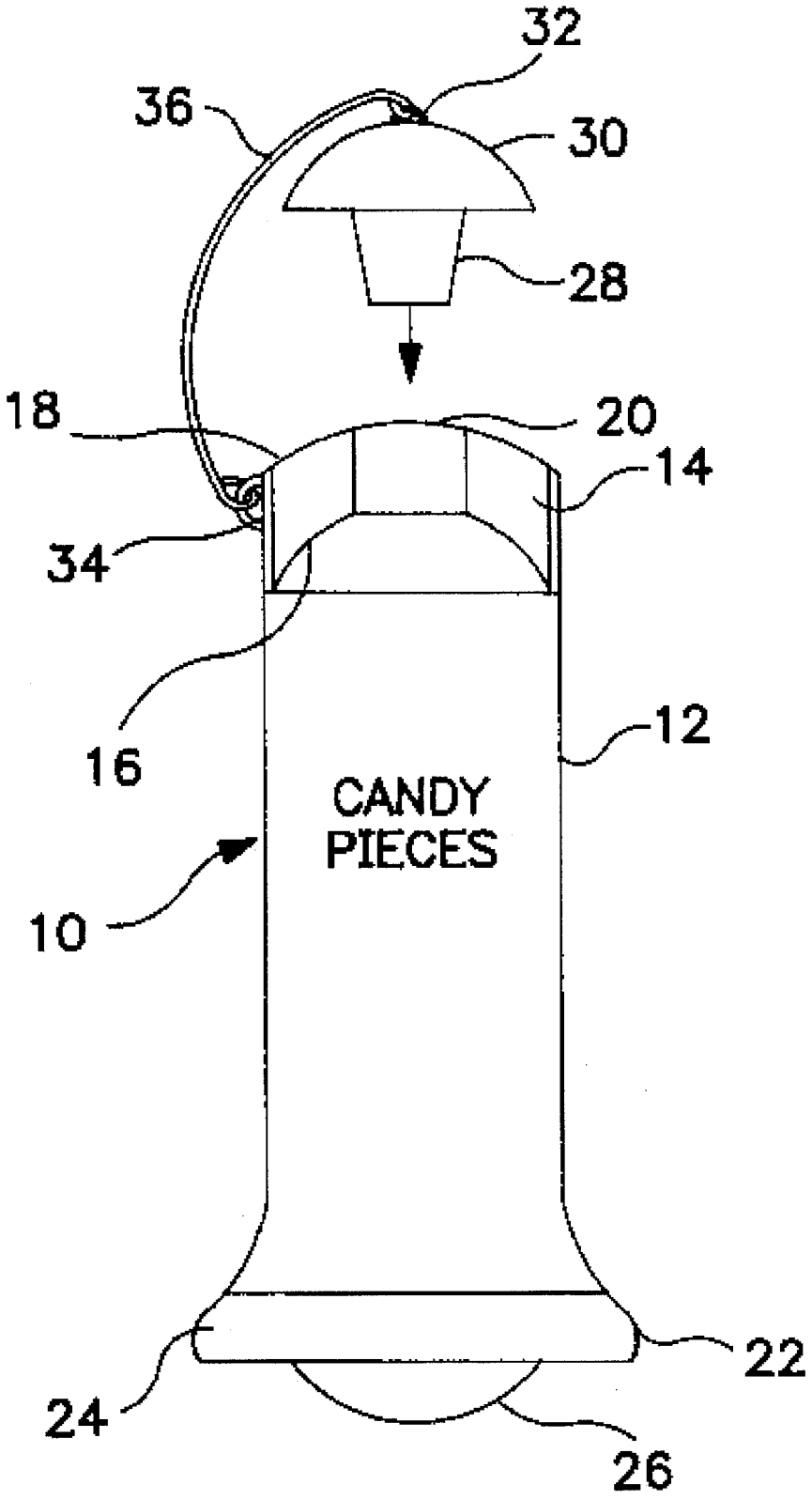
FIG. 1 is a side view of the device which illustrates the container and closure cap.

Now referring to the drawings, there is shown a candy container 10 which may be made of any suitable material such as clear plastic. As shown in FIG. 1, the candy container includes a main housing 12 which is cylindrical along a major portion of the body which extends upwardly to an upper end closure 14 which is inserted into the upper open end or made as an integral part thereof. The upper end closure has a semi-spherical bottom surface 16 with a somewhat rounded upper end 18. The upper end includes a cylindrical central aperture 20 which has a cross-section which is larger than the pieces of candy to be dispensed or which is not large enough for two pieces to pass through at the same time. The bottom end of the main housing curves outwardly to an enlarged end 22. A solid balance ring 24 is contained within the enlarged end and a bottom end closure cap 26 closes the bottom end with a somewhat semi-spherical shape that extends downwardly from the end of the main housing and balance ring 24.

The upper end closure 14 of the main housing is provided with a top cap that fits into the aperture with a tight fit. The cap is shaped with a central portion 28 with an upper semi-spherical portion 30 which extends outwardly from the central portion. An eye opening 32 is formed on the upper surface of the semi-spherical portion of the end cap and an eye opening 34 is formed on the main housing near the upper end. A line 36 of any suitable material is secured at each end to the eye openings in order to secure the top cap to the housing.

In use, the housing is substantially filled with pieces of candy having a size that will easily fit through the aperture 20. Once the housing is filled with candy the cap is secured to the upper end of the housing and fitted into the aperture. With the cap removed, only one piece of candy will fit through the aperture at any one time. That is, two pieces would not fit through at the same time. If the candy is substantially the size of the aperture then the housing can be shaken and if a hard type of candy is within the container the candy will make a rattle noise. Therefore, the candy container can also be used as a rattle if desired. The rattle could be made with the cap in place also.

The bottom is somewhat semi-spherical and of larger diameter with a balance ring. This is so constructed that the candy container will set at any angle and could be moved angularly with a surface upon which it sits. The balance ring adds weight to the bottom so that the container will not be top heavy and fall over but will set at an angle with the surface and can wobble on the bottom end in an upright position.

Figure 2:
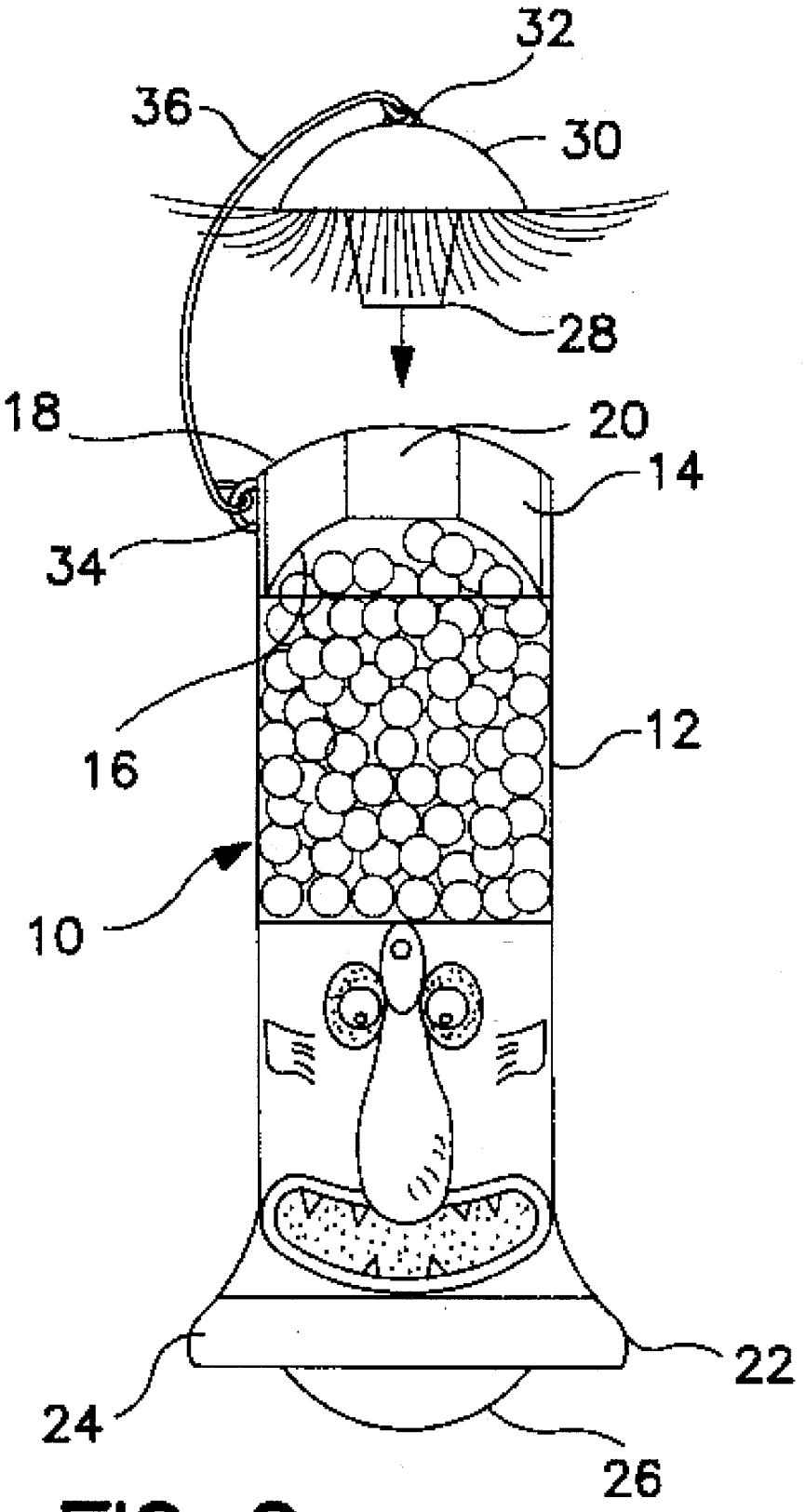
FIG. 2 is a side view which illustrates pieces of candy within the container and an illustrative drawing on a surface of the container.

FIG. 2 illustrates the device with a funny looking face on the bottom portion with the candy pieces shown above the face. The cap is shown with a fringe around its face which could represent a hat. Thus, the candy container can be called a "JAR HEAD".

What is claimed:

1. A container and dispenser having a main housing, said main housing having an upper end and a lower end, said upper end having an enclosure with an aperture therein, said lower end having a balance ring having a larger diameter than a body of the main housing, a bottom closure confined within said balance ring and said lower end having a somewhat semi-sphertical shape extending outwardly of said balance ring, said semi-spherical shaped lower end permits the container to be set on an angle relative to a surface and permits the container to wobble on the lower end.

2. A container and dispenser as set forth in claim 1, which comprises a top cap for closing said aperture within said upper end enclosure.

3. A container and dispenser as set forth in claim 2, which comprises means for securing said top cap to said main housing.

4. A container and dispenser as set forth in claim 1, wherein said main housing is cylindrical in shape.

5. A container and dispenser as set forth in claim 1 in which said enclosure of said upper end is removable and which includes a portion that is inserted into an open upper end of said housing.

6. A container and dispenser as set forth in claim 1 in which said enclosure is an integral part of said main housing.

* * * * *